US011125257B1

(12) United States Patent
Dabirian et al.

(10) Patent No.: US 11,125,257 B1
(45) Date of Patent: Sep. 21, 2021

(54) FLOW CONDITIONING SYSTEM FOR HOMOGENIZING SLUG FLOW

(71) Applicant: The University of Tulsa, Tulsa, OK (US)

(72) Inventors: Ramin Dabirian, Tulsa, OK (US); Srinivas Swaroop Kolla, Tulsa, OK (US); Ram S. Mohan, Broken Arrow, OK (US); Ovadia Shoham, Tulsa, OK (US)

(73) Assignee: The University of Tulsa, Tulsa, OK (US)

( * ) Notice: Subject to any disclaimer, the term of this patent is extended or adjusted under 35 U.S.C. 154(b) by 23 days.

(21) Appl. No.: 16/826,910

(22) Filed: Mar. 23, 2020

Related U.S. Application Data

(60) Provisional application No. 62/825,104, filed on Mar. 28, 2019.

(51) Int. Cl.
*F15D 1/02* (2006.01)
*B01F 5/06* (2006.01)
*F15D 1/00* (2006.01)

(52) U.S. Cl.
CPC ..... *F15D 1/025* (2013.01); *B01F 5/0609* (2013.01); *F15D 1/001* (2013.01)

(58) Field of Classification Search
CPC ..... F15D 1/025; F15D 1/001; B01F 5/0609
USPC ..... 138/37
See application file for complete search history.

(56) References Cited

U.S. PATENT DOCUMENTS 3,727,643 A * 4/1973 Blackmore ..... F16K 51/00 138/41
4,185,715 A * 1/1980 Reu Boiu ..... F01N 1/02 181/227
4,318,368 A * 3/1982 Carson ..... F22B 37/327 122/34

(Continued)

OTHER PUBLICATIONS

Jamialahmadi et al, "EEffect of Superficial Gas Velocity on Bubble Size, Terminal Bubble Rise Velocity and Gas Hold-Up in Bubble Columns", , pp. 16-31, vol. 1, No. 1, Publisher: Developments in Chemical Engineering (1992).

(Continued)

*Primary Examiner* — Craig M Schneider
*Assistant Examiner* — David R Deal
(74) *Attorney, Agent, or Firm* — GableGotwals

(57) ABSTRACT

Embodiments of a Flow Conditioning System ("FCS") of this disclosure may be used for homogenizing a fluid containing a gas phase and a liquid phase. In some embodiments the FCS may be applied to a fluid containing hydrocarbons. The FCS may be located where appropriate, including but not limited to subsea. The FCS may be used for homogenizing slug flow. In embodiments, the FCS may be composed of an outer shroud pipe section, into which a concentric perforated smaller pipe is inserted at the top. The inlet slug flow regime is changed at the shroud section whereby the slugs are broken, transitioning to well-mixed flow regimes, such as bubbly flow or continuous churn flow. The bubbly or continuous churn flow that occur in the shroud section are forced to pass through the perforations of the perforated smaller diameter pipe, which promote a more thorough mixing of the phases upstream of devices such as multiphase pumps.

20 Claims, 7 Drawing Sheets

(56) References Cited

U.S. PATENT DOCUMENTS

| | | | | |
|---|---|---|---|---|
| 4,574,837 | A * | 3/1986 | Aggour | F16L 41/00 137/561 A |
| 4,662,391 | A * | 5/1987 | Tolley | B01D 19/0042 137/393 |
| 7,073,534 | B2 * | 7/2006 | Sawchuk | F15D 1/02 138/39 |
| 7,249,614 | B2 * | 7/2007 | Vakili | F15D 1/02 138/116 |
| 7,261,120 | B2 * | 8/2007 | Muller | B01D 45/08 137/154 |
| 8,444,004 | B1 * | 5/2013 | Draganic | A47G 19/2205 220/719 |
| 10,036,660 | B2 * | 7/2018 | Ishihara | G01F 15/06 |
| 2010/0147773 | A1 | 6/2010 | Kouba et al. | |
| 2017/0067765 | A1 * | 3/2017 | Koike | G01F 15/068 |
| 2019/0085879 | A1 * | 3/2019 | Frohnapfel | F15D 1/025 |
| 2020/0041375 | A1 * | 2/2020 | Bowdle | G01M 9/065 |

OTHER PUBLICATIONS

Jamialahmadi et al, "Effect of Alcohol, Organic Acid and Potassium Chloride Concentration on Bubble Size, Bubble Rise Velocity and Gas Hold-up in Bubble Columns", , pp. 47-56, vol. 50, Publisher: Chemical Engineering Journal (1992).

Radovicich et al, "The Transition from Two-Phase Bubble Flow to Slug Flow", "Report 7-7673-22, Jun. 1962", , Publisher: MIT.

Taitel et al, "A Model for Predicting Flow Regime Transition in Horizontal and Near Horizontal Gas-Liquid Flow", "Jan. 1976", , pp. 47-55, vol. 22, No. 1, Publisher: AIChE Journal.

Wallis, "One-Dimensional Two-Phase Flow", , Publisher: New York: McGraw-Hill, 1969.

* cited by examiner

FLOW CONDITIONING SYSTEM FOR HOMOGENIZING SLUG FLOW

CROSS-REFERENCE TO CO-PENDING APPLICATIONS

This application claims priority to, and the benefit of, U.S. 62/825,104 filed Mar. 28, 2019.

BACKGROUND

This disclosure is in the field of apparatuses, systems, and methods intended to mix or homogenize a fluid containing a gas phase and a liquid phase.

Devices such as gas-liquid multiphase flow pumps are susceptible to malfunctioning under slug flow conditions. These conditions occur when long gas pockets are produced in the flow upstream of the multiphase pump and the multiphase fluid becomes segregated by the pockets into "slugs" of liquid and gas.

Under these conditions the pumps run "dry", without sufficient liquid, which can result in pump overheating and seizing thus leading to failure. A need exists for apparatuses, systems, and methods that ensure liquid flow in the pump at all times, which avoids overheating of the pump and related problems.

SUMMARY

Embodiments of a novel Flow Conditioning System ("FCS") of this disclosure may be used for homogenizing a fluid containing a gas phase and a liquid phase. In some embodiments the FCS may be applied to a fluid containing one or more hydrocarbons. The FCS may be located where appropriate, including subsea. The FCS may be used for homogenizing slug flow, characterized by highly concentrated liquid followed by a long gas pocket. In embodiments, the FCS may be composed of an outer shroud pipe section, into which a concentric perforated smaller pipe is inserted at the top. The inlet slug flow regime is changed at the shroud whereby the slugs and gas pockets are broken, transitioning to well-mixed flow regimes, such as bubbly flow or continuous churn flow. The bubbly or continuous churn flow that occur in the shroud section are forced to pass through the perforations of the perforated smaller pipe, which promote a more thorough mixing of the phases upstream of devices such as multiphase pumps.

DRAWINGS

DETAILED DESCRIPTION

Figure 1A:
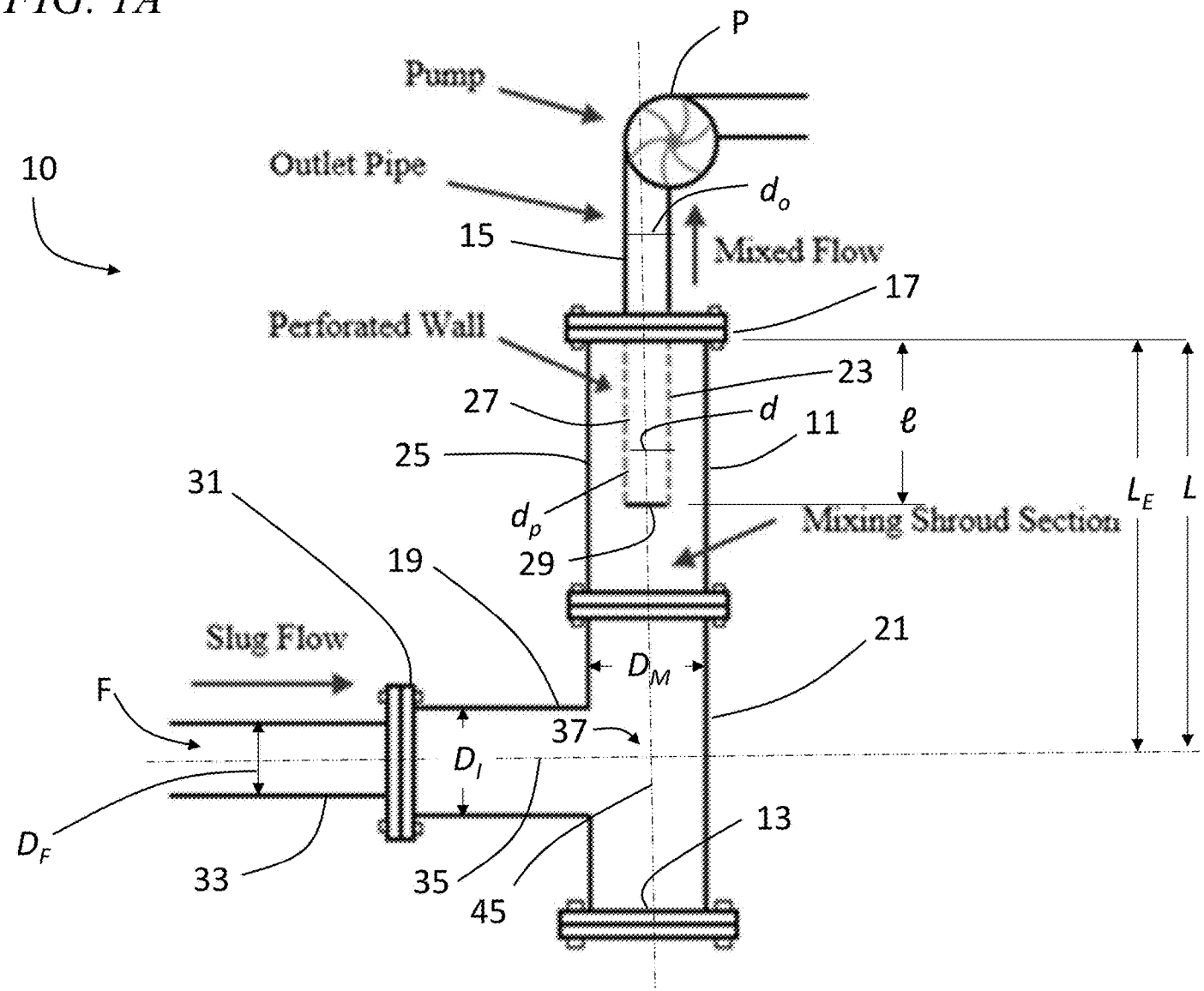
FIG. 1A is a schematic of an embodiment of a flow conditioner of this disclosure.
Figure 1B:
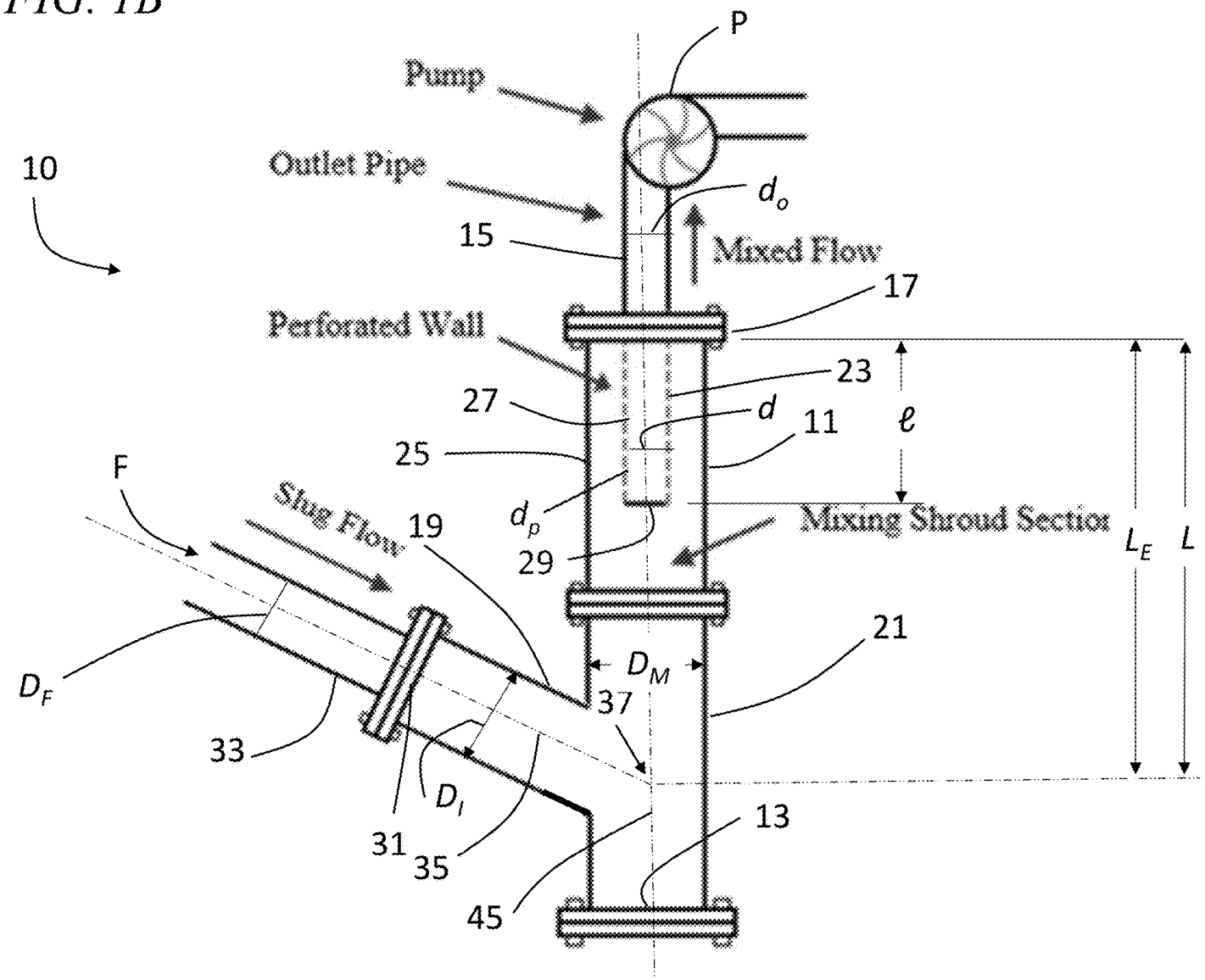
FIG. 1B is a schematic of another embodiment of a flow conditioner of this disclosure.

Referring first to FIGS. 1A & 1, embodiments of a Flow Conditioning System ("FCS") 10 of this disclosure have four main sections, including:

- a horizontal or downward inclining inlet 19 configured for connection to an upstream feed pipe 33, the inlet 19 located toward a closed bottom end 13 of the FCS 10 and having an inner diameter "$D_I$" greater than or equal to an inner diameter "$D_F$" of the upstream feed pipe 33;
- a vertical mixing shroud section 11 connected to the inlet 19, the mixing shroud section 11 arranged concentric to a vertical central axis or centerline 45 of the FCS 10 and having a length "L" and an inner diameter "$D_M$" equal to, or substantially equal to, that of the inlet 19 diameter $D_I$;
- a vertical perforated pipe 23 contained within mixing shroud section 11 and arranged concentric to the vertical central axis 45, the pipe 23 having a length "l", an inner diameter "d", $d<D_M$ and perforations 27 having diameter "$d_p$"; and
- a vertical outlet 15 arranged concentric to the vertical axis and connected to an uppermost end of the pipe 23, the vertical outlet 15 having a diameter "$d_o$" and configured for connection to a downstream device such as multiphase pump P. See FIGS. 1A & 1B.

For the purposes of this disclosure, the length L of the vertical mixing shroud section 11 is the distance from where the centerline 35 of the inlet 19 intersects the vertical central axis or centerline 45 of the FCS 10 to the uppermost upper (topmost) end 17 of the mixing shroud section 11. This intersection of the centerlines 35, 45 is considered the inlet end 37 of the vertical mixing shroud section 11, the uppermost upper end 17 being the outlet end of the section 11. As explained below, the length L may be equal to or less than a calculated maximum entry region length "$L_E$" to sustain churn flow. In no cases should the length L be greater than $L_E$, nor should the inlet end 31 of the vertical mixing shroud section 11 lie below the horizontal centerline 35. The ratio of the length l of the vertical perforated pipe 23 to the length L of the vertical mixing shroud section 11 may in a range of $\frac{1}{4}L_E \leq l \leq \frac{1}{2}L_E$.

By way of a non-limiting example, in an experimental embodiment used for testing, an FCS 10 of this disclosure was constructed using a 0.076 m ID transparent PVC pipe, including an inlet 19 (0.5 m long) and a vertical mixing shroud section 11 (1.4 m in length). The FCS inlet 19 was connected to a horizontal 0.05 m ID upstream feed pipe 33. In this example, $D_I>D_F$ (0.076 m to 0.05 m). A larger inlet diameter $D_I$ (about 1.5 times that of the feed pipe diameter $D_F$) was used to reduce the gas phase velocity and help mixing of the phases in the mixing shroud section 11.

The length L of the mixing shroud section 11 may be obtained based on the study of Taitel et al. (1986) for determining the maximum entry region length ($L_E$) to sustain churn flow, as given by $$\frac{L_E}{D} = 42.6\left(\frac{V_M}{\sqrt{gD}} + 0.29\right), \tag{1}$$

where D is the inner diameter $D_M$ of the mixing shroud section, $V_M$ is the mixture velocity, and g is the gravitational acceleration. See Taitel, Y. and Dukler, A. E.: "A Model for Predicting Flow Regime Transition in Horizontal and Near Horizontal Gas-Liquid Flow," *AIChE J.*, vol. 22, no. 1, pp.

47-55, 1976. According to this study, if the actual vertical pipe length L is less than $L_E$, churn flow (ideal for better mixing of gas and liquid phases) will occur in the entire pipe, otherwise, slug flow will occur.

Figure 2:
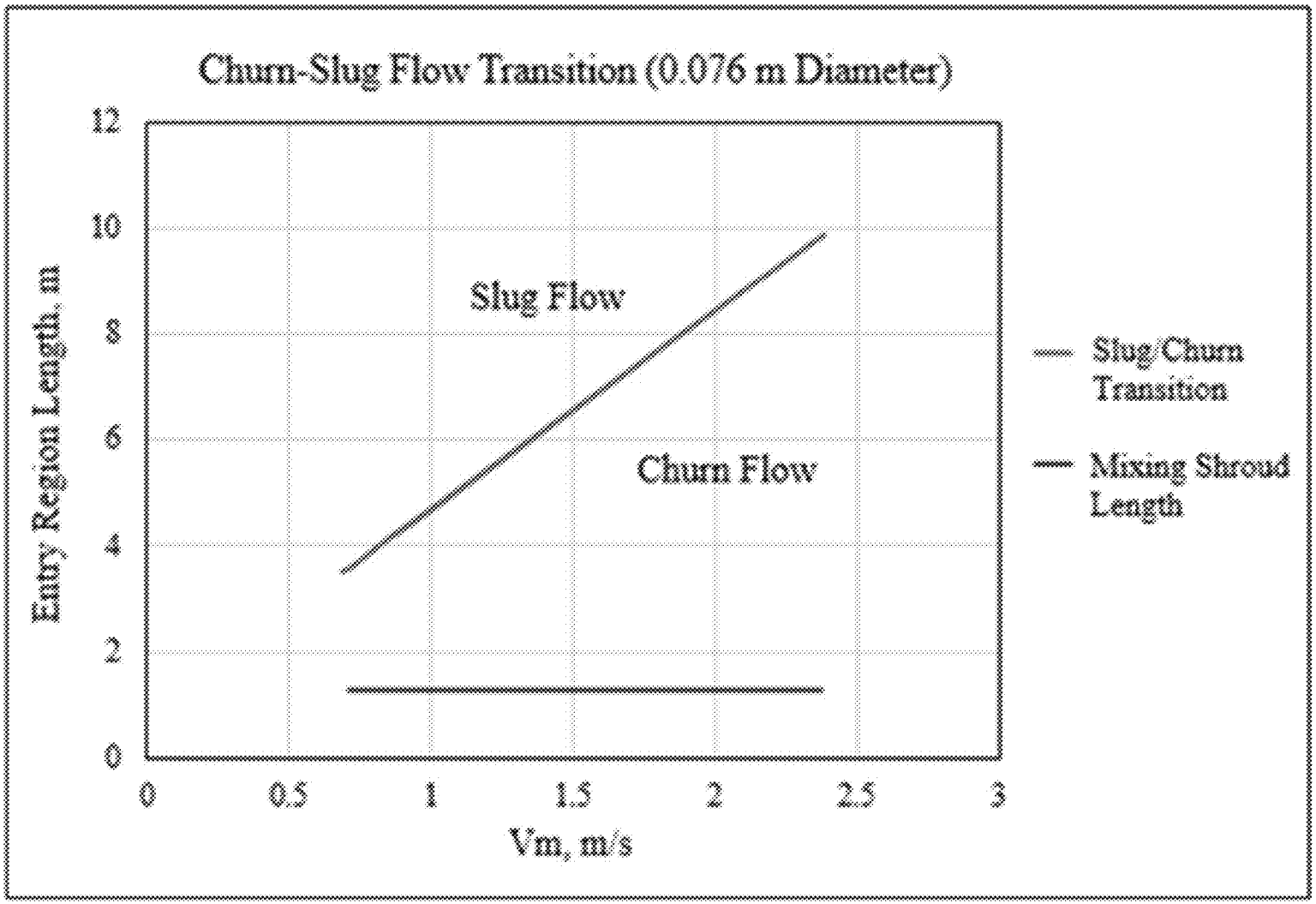
FIG. 2 is a graph depicting churn flow—slug flow transition for 0.076 m inner diameter ("ID") vertical mixing shroud.

Continuing with the same example as above, FIG. 2 shows the transition between churn flow and slug flow predicted by Eq. 1, for the 0.076 m ID vertical mixing shroud section 11, demonstrating that the 1.4 m long mixing shroud section 11 promotes churn flow over the entire mixture velocity ($V_M$) range. Therefore, $L_E$ places an upper bound on the length L of the vertical mixing shroud section 11. In embodiments, $L \leq L_E$, the lower bound being in a range of 70% to 80% of $L_E$, there being sub-ranges and individual discrete values within this broader range.

By way of a non-limiting example, a 0.038 m ID 0.05 m long vertical perforated pipe section 23 is inserted into a vertical mixing shroud section 11 from the top 17 of the FCS 10, which in turn is connected to the vertical outlet 15, upstream of the multiphase pump P. The FCS includes a 0.076 m horizontal inlet 19 connected to a 0.05 m ID horizontal feed pipe 33, with sections 11, 23, and 15 arranged concentric to the vertical centerline 45 of the FCS 10. The inlet diameter of the pump P is the same as that of diameter $d_o$ of the outlet 15. The length L of the vertical mixing shroud section 11 was calculated using Eq. 1 above, where $L=L_E$. The vertical perforated pipe section 23 includes perforations 27 having a uniform diameter of 0.005 m each, with a ratio of 0.2 between the total perforated area to the total surface area of the pipe section 23.

The total perforated area in this example is equal to the cross-sectional area of the vertical pipe section 23. If the total area of the perforations is increased more than the cross-sectional area of the perforated pipe 23, the perforations 27 can promote uneven flow in the vertical perforated pipe section 23 due to improper mixing or churning of liquid and gas since the gas has a higher tendency to escape than does the liquid. This uneven flow could be severely felt in cases where a gas pocket follows a liquid slug thereby resulting in improper mixing (i.e., liquid not being retained in the upper part 25) and thus leading to failure of multiphase pump. If the total area of the perforations is less than that of the cross-sectional area of the perforated pipe 23, excessive pressure drop is created across the perforations 27.

Testing by the inventors has shown that the bottom 29 of the vertical perforated pipe section 23 should be a closed bottom end and not an open end. Testing has also shown that extension of the vertical pipe section 23 further downwards below the inlet to the vertical mixing shroud section 11—that is, below the horizontal center line 35—with or without the presence of a perforated section, did not enhance the performance. This finding is unexpected and surprising because it is in contradiction to the teaching of US2010/0147773 A1 to Kouba et al., which recommends the bottom of the perforated concentric pipe to be open and its length extended to the bottom of the vertical pipe (e.g., below the center line 35 toward or to the bottom 13 of the pipe section 11).

Figure 3:
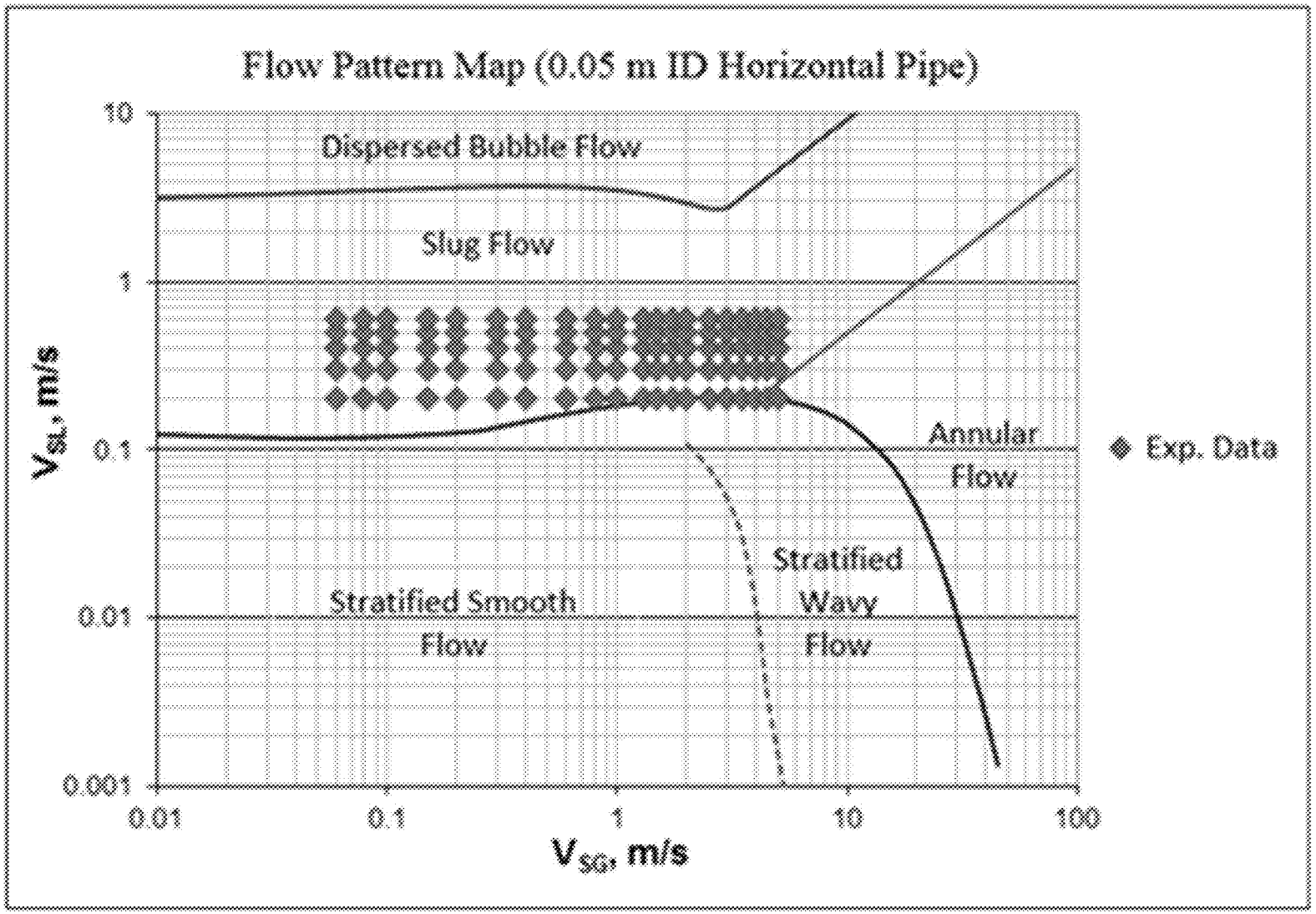
FIG. 3 is a flow pattern map for a horizontal 0.05 m ID feed pipe.
Figure 4:
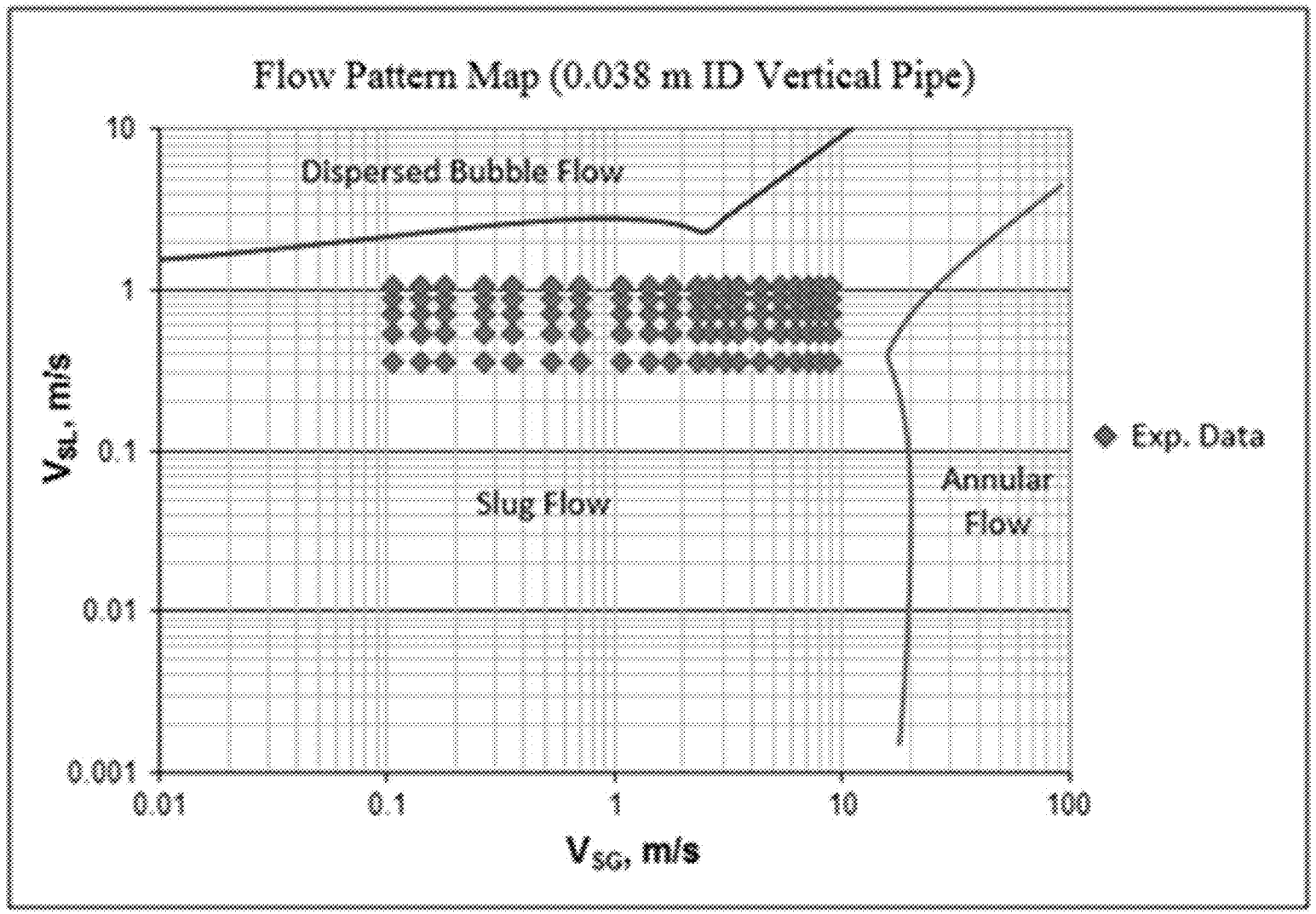
FIG. 4 is a flow pattern map for a 0.038 m ID vertical outlet pipe without a flow conditioner of this disclosure.

Experimental data were acquired with the example FCS in order to evaluate its performance. Various combinations of superficial gas and liquid velocities were selected as a test matrix to ensure slug flow in the 0.05 m ID horizontal feed pipe 33. FIG. 3 presents the test matrix and operational conditions in the feed pipe on a Taitel et al. flow pattern map. See Taitel, Y. and Dukler, A. E.: "A Model for Predicting Flow Regime Transition in Horizontal and Near Horizontal Gas-Liquid Flow," *AIChE J.*, 22, no. 1, pp. 47-55, 1976. As can be seen, all the data are collected under slug flow conditions (in the inlet horizontal pipe). Similarly, FIG. 4 presents the same operational conditions on a Taitel et al. vertical flow pattern map, which is plotted for the 0.038 m ID vertical pipe, which is located upstream of the multiphase pump. As can be seen, according to Taitel et al., the predicted flow pattern in the vertical pipe with 0.038 m ID is also slug flow. This is the flow that would be expected.

However, when an FCS 10 of this disclosure is utilized on the flow experimental data show that, under all the operational flow conditions, the flow pattern in the FCS vertical outlet pipe 15 is either churn flow or bubbly flow. The experimental flow pattern observations are plotted in FIG. 5. The change in the flow pattern predictions (FIG. 4) and the experimental observations (FIG. 5) is due to the effect of the perforations 27 modifying the flow behavior in the vertical mixing shroud section 11.

Figure 5:
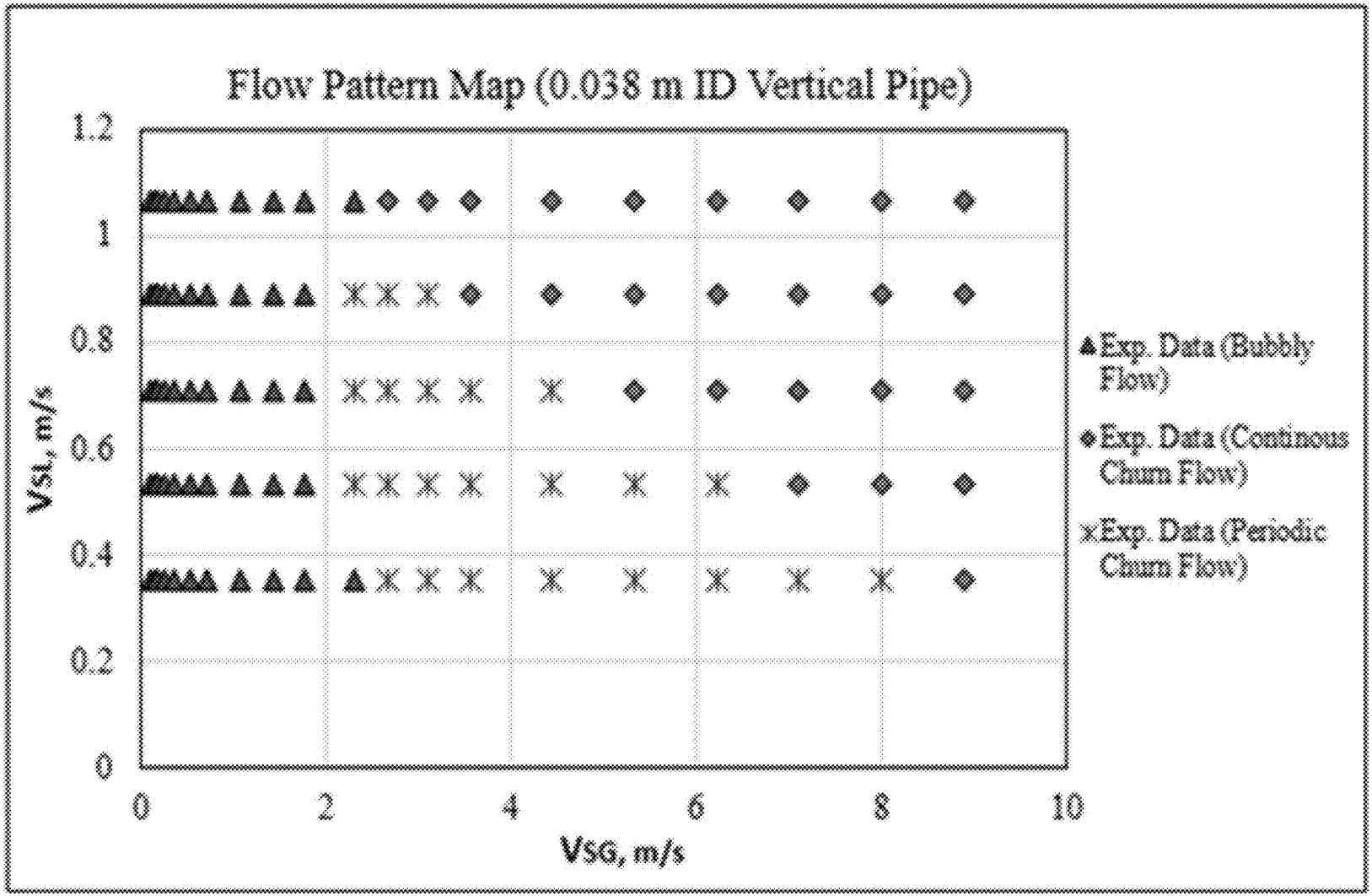
FIG. 5 is an experimental flow pattern map for a 0.038 m ID vertical outlet pipe when connected to a flow conditioner of this disclosure.

As shown in FIG. 5, bubbly flow occurs in the outlet pipe 15 at low superficial gas velocities. For this condition, small gas bubbles are entrained in the liquid-phase, whereby the bubbles move upward in a linear path similar to rigid spheres without colliding and coalescing. With increasing superficial gas velocity, increasing bubble concentration and deformation of the bubble lead to increasing bubble coalescence and ultimately transition to churn flow.

In this study, the churn flow pattern is divided into two sub-patterns: periodic churn flow and continuous churn flow (see FIG. 5). For periodic churn flow, there is an upward and downward oscillatory motion of liquid phase, due to the relatively low gas and liquid velocities. With increasing superficial gas and liquid velocities, as shown in FIG. 5, the flow pattern changes to continuous churn flow, where a continuous upward movement of the liquid phase results, and well mixing of the phases is achieved. Since the multiphase pump operates poorly under the separated individual gas and liquid flows especially when slug flow gas pockets are produced, embodiments of the FCS 10 of this disclosure should operate either under bubbly flow or continuous churn flow, ensuring well mixing of the phases upstream of the pump.

Proper operation of the FCS 10 depends on the existing flow pattern in the vertical outlet pipe 15 upstream of the pump. Mechanistic models are presented below for flow pattern predictions, which may be used for design and scale-up purposes. Two models are presented for the predictions of the transition between the bubbly flow and churn flow, as well as the transition between periodic churn flow and continuous churn flow, as described as below.

Bubbly Flow—Churn Flow Transition:

At relatively low superficial gas velocities, as described above, low concentration bubbles occur that behave as rigid spheres with no collisions and coalescence. With increasing the gas velocity, the bubble concentration increases, with bubble deformation, thereby promoting bubble coalescence and formation of larger bubbles, leading to churn flow. Thus, the transition between the bubbly flow and churn flow is based on bubble packing concept.

According to Radovicich et al., bubble collision frequency depends on gas void fraction "α", which increases significantly when the void fraction reaches 0.2. See Radovicich, N. A. and Moissis, R.: "The Transition from Two-Phase Bubble Flow to Slug Flow", MIT Report 7-7673-22, 1962. On the other hand, the observed maximum gas void fraction under bubbly flow is $\alpha=0.3$. For purposes of this disclosure, the criterion used for the transition between bubbly flow and churn flow is when the gas void fraction reaches 0.3. This transition boundary is developed next.

The slip velocity, Vs, between the gas and liquid phase is defined as $$V_S = V_G - V_L \tag{2}$$

where $V_G$ and $V_L$ are the actual gas and liquid velocities, respectively, which are given by $$V_G = \frac{V_{SG}}{\alpha} \tag{3}$$

$$V_L = \frac{V_{SL}}{1-\alpha} \tag{4}$$

In above equations, $V_{SG}$ is the superficial gas velocity, and $V_{SL}$ is the superficial liquid velocity. It follows $$V_S = mV_{0\infty}(1-\alpha)^{n-1} \tag{5}$$

where m and n are empirical coefficients and $V_{0\infty}$ is the bubble rise velocity, which is determined according to Jamialahmadi et al.

$$V_{0\infty} = \frac{V_{0\infty,S}V_{0\infty,W}}{\sqrt{V_{0\infty,S}^2 + V_{0\infty,W}^2}} \tag{6}$$

See Jamialahmadi, M. and Muller-Steinhagen, H.: Effect of Superficial Gas Velocity on Bubble Size, Terminal Bubble Rise Velocity and Gas Hold-Up in Bubble Columns, J. Developments in Chemical Engineering and Mineral Processing, Vol. 1, pp. 16-31 (1992).

The variables $V_{0\infty,S}$ and $V_{0\infty}$ are expressed, respectively, by $$V_{0\infty,S} = \frac{1}{18}\frac{\rho_L - \rho_G}{\mu_L} g d_b^2 \frac{3\mu_L + 3\mu_G}{2\mu_L + 3\mu_G} \tag{7}$$

$$V_{0\infty,W} = \sqrt{\frac{2\sigma}{d_b(\rho_L - \rho_G)} + \frac{g d_b}{2}} \tag{8}$$

In the above equations, $\rho_L$, $\rho_G$ and $\mu_L$, $\mu_G$ are the liquid and gas densities and liquid and gas viscosities, respectively, g is the acceleration due to gravity, $\sigma$ is the surface tension and $d_b$ is the bubble diameter. In this study, $d_b$ is determined as given by Jamialahmadi et al., namely, $$d_b = \left(\frac{6d_p\sigma}{g(\rho_L - \rho_G)}\right)^{\frac{1}{3}} \tag{9}$$

where, $d_p$ is the diameter of each perforation. Using $\alpha$=0.3 and substituting Eqs. (3) through (9) into the Eq. (2) results in an equation for the prediction of transition boundary between bubbly flow and churn flow. See Jamialahmadi, M. and Muller-Steinhagen, H.: "Effect of Alcohol, Organic Acid and Potassium Chloride Concentration on Bubble Size, Bubble Rise Velocity and Gas Hold-up in Bubble Columns", *Chem. Eng. J.,* 50, pp. 47-56, 1992.

Transition Between Periodic Churn and Continuous Churn Flow

Wallis developed a semi-empirical correlation to predict the transition to flooding and flow reversal. See Wallis, G. B.: "One-Dimensional Two-Phase Flow", New York: McGraw-Hill, 1969. This correlation predicts the onset of countercurrent flow between the gas and liquid phases as follows:

$$\sqrt{V_{SG}^*} + \sqrt{V_{SL}^*} = C \tag{10}$$

where the dimensionless variables $V_{SG}^*$ and $V_{SL}^*$ are given, respectively, by $$V_{SG}^* = V_{SG}\frac{\sqrt{\rho_G}}{\sqrt{gD(\rho_G - \rho_L)}} \tag{11}$$

$$V_{SL}^* = V_{SL}\frac{\sqrt{\rho_G}}{\sqrt{gD(\rho_G - \rho_L)}} \tag{12}$$

Figure 6:
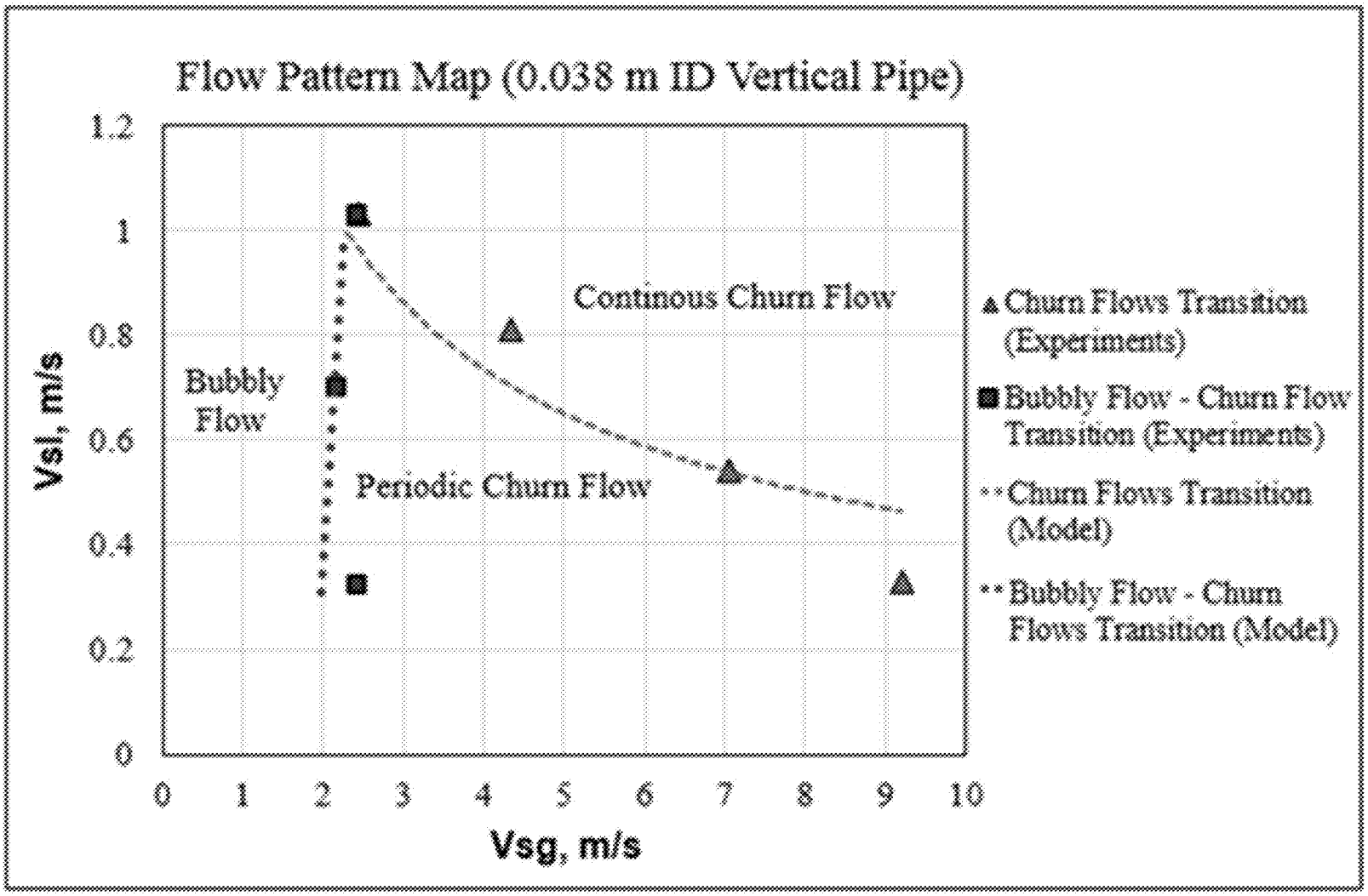
FIG. 6 is a comparison between acquired data and models of a flow conditioner of this disclosure.

This correlation is used in this study to predict the transition between continuous churn flow (where the liquid phase flows mainly upwards) to periodic churn flow (where the liquid phase flows downwards also), assigning a value of C=1.65. FIG. 6 shows a comparison between the developed flow pattern prediction models and the acquired experimental data for the two transition boundaries, namely, bubbly flow/churn flow and between periodic-churn/continuous-churn flow. The figure clearly demonstrates that the models predict the transition boundaries with high accuracy.

EXAMPLES

Embodiments of an FCS system of this disclosure, and method for its use may include the following designs or configurations.

1. A flow conditioner 10 configured for mixing a fluid containing a gas-phase and a liquid-phase, the flow conditioner 10 comprising: a vertically oriented outer shroud section 11 having an entry region length "$L_E$" and an inner diameter "$D_I$", the vertically oriented outer shroud section 11 including a closed bottommost bottom end 13; a vertically oriented outlet 15 arranged concentric to, and located at an uppermost upper end 17 of, the vertically outer shroud section 11, the vertically oriented outlet 15 having an inner diameter "$d_o$"; the vertically outer shroud section 11 further comprising an inlet 19 having a same, or substantially same, inner diameter "$D_M$" as the inner diameter $D_I$ outer shroud section 11 and connected to a lower half 21 of the outer shroud section 11; and a vertically oriented pipe 23 arranged concentric to, and housed within an upper half 25 of the vertically oriented outer shroud section 11 and connected to the vertically oriented outlet 15, the vertically oriented pipe 23 having a length "l" including perforations 27, an inner diameter "d", and a closed bottommost bottom end 29, the perforations 27 having a diameter "$d_p$"; wherein $L_E$ is a total vertical distance between the uppermost upper end 17 of the vertically oriented shroud section 11 and a centerline 35 of the inlet 19; and wherein $D_M$>d; and wherein d=$d_o$.

2. The flow conditioner 10 of example 1, wherein a total perforated area of the vertically oriented pipe 23 is in a range of 0.95 to 1.05 of a total cross section area of the vertically oriented outlet 15.

3. The flow conditioner 10 of example 2, wherein the total perforated area of the vertically oriented pipe 23 is equal to the total cross section area of the vertically oriented outlet 15.

4. The flow conditioner 10 according to any of the preceding examples, wherein a ratio of a total perforated area of the vertically oriented pipe 23 to a total surface area of the vertically oriented pipe 23 is in a range of 0.1 to 0.3.

5. The flow conditioner 10 of example 4, wherein the ratio is 0.2.

6. The flow conditioner 10 according to any of the preceding examples, wherein $d_p$ is sized to create, for the gas phase, a predetermined bubble diameter "$d_b$".

7. The flow conditioner 10 of example 6, 0.0045 m≤$d_p$≤0.0055 m.

8. The flow conditioner 10 of example 7, $d_p$=0.005 m

9. The flow conditioner 10 according to any of the preceding examples, wherein the entry region length $L_E$ is a length preselected to provide churn flow of the fluid along a vertical distance beginning at the intersection of the centerline 35 of the inlet 19 and the central vertical axis to the vertically oriented outlet 15, where $$\frac{L_E}{D} = 42.6\left(\frac{V_M}{\sqrt{gD}} + 0.29\right),$$

where D is the diameter of the vertically oriented outer shroud section 11, $V_M$ is the mixture velocity, and g is gravitational acceleration.

10. The flow conditioner 10 according to any of the preceding examples, wherein ¼$L_E$≤l≤½ $L_E$.

11. The flow conditioner according to any of the preceding examples, wherein the inlet 19 includes an end 31 configured for connection to a feed pipe 33 having a predetermined inner diameter "$D_F$".

12. The flow conditioner 10 of example 11, wherein D≥$D_F$.

13. The flow conditioner 10 of example 11 wherein D>$D_F$.

14. The flow conditioner 10 according to any of the preceding examples, wherein the inlet 19 is selected from the group consisting of a horizontally oriented inlet and a downward inclined inlet.

15. The flow conditioner 10 of any of the preceding examples, further comprising:

a multi-phase pump connected to the outlet.

16. The flow conditioner 10 according to any of the proceeding examples, further comprising:

a riser connected to the outlet.

17. The flow conditioner 10 according to any of the preceding examples, wherein the flow conditioner contains no moving parts.

18. The flow conditioner 10 according to any of the preceding examples, wherein the flow conditioner does not require a power supply.

19. A process for mixing a fluid containing a gas-phase and a liquid phase, the process comprising: routing the fluid through a flow conditioner 10 comprising: a vertically oriented outer shroud section 11 having an entry region length "$L_E$" and an inner diameter "$D_M$", the vertically oriented outer shroud section 11 including a closed bottommost bottom end 13; a vertically oriented outlet 15 arranged concentric to, and located at an uppermost upper end 17 of the vertically oriented outer shroud section, the vertically oriented outlet 15 having an inner diameter "$d_o$"; the vertically oriented outer shroud section 11 further comprising an inlet 19 having a same inner diameter "$D_I$" as the inner diameter $D_M$ of the vertically oriented outer shroud section 11 and connected to a lower half 21 of the vertically oriented outer shroud section 11; and; a vertically oriented pipe 23 arranged concentric to, and housed within an upper half 25 of, the vertically oriented outer shroud section 11 and connected to the vertically oriented outlet 15, the vertically oriented pipe 23 having a length "l" including perforations 27, an inner diameter "d", and a closed bottommost bottom end 29, the perforations 27 having a diameter "$d_p$"; wherein $L_E$ is a total vertical distance between the uppermost upper end 17 of the vertically oriented outer shroud section 11 and a centerline 35 of the inlet 19 where it intersects a shared vertically oriented centerline 45 of the vertically oriented outer shroud section 11, vertically oriented pipe 23, and vertically oriented outlet pipe 15; wherein D>d and d d; wherein after the routing, the gas-phase is more evenly distributed throughout the fluid than prior to the routing.

20. The process of example 19, wherein a total perforated area of the vertically oriented pipe 23 is in a range of 0.95 to 1.05 of a total cross section area of the vertically oriented outlet 15.

21. The process according to any of the preceding examples, wherein a ratio of a total perforated area of the vertically oriented pipe 23 to a total surface area of the vertically oriented pipe 23 is in a range of 0.1 to 0.3.

22. The process according to any of the preceding examples, wherein between the inlet 19 and the vertically oriented outlet 15 of the flow conditioner 10 the fluid transitions from predominantly slug flow to predominantly churn flow.

23. The process according to any of the preceding examples, wherein an average gas bubble diameter $d_p$ of the gas-phase at the vertically oriented outlet 15 is less than that at the inlet 19.

24. The process according to any of the preceding examples, wherein the fluid enters the inlet 19 from a feed pipe 33 connected to the inlet 19, the feed pipe having a predetermined inner diameter "$D_F$"

25. The process of example 24, wherein D≥$D_F$.

26. The process of example 24, wherein D>$D_F$.

27. The process of according to any of the preceding examples, wherein the gas-phase, the liquid phase, or the gas and liquid phases include a hydrocarbon.

28. The process according to any of the preceding examples, further comprising:

after the routing, passing the fluid through a multi-phase pump P.

29. The process of according to any of the preceding examples, wherein the flow conditioner is located subsea.

30. The process according to any of the preceding examples, wherein the inlet 19 is selected from the group consisting of a horizontally oriented inlet and a downward inclined inlet.

31. The process according to any of the preceding examples, wherein a multi-phase pump P is connected to the vertically oriented outlet 15.

32. The process according to any of the proceeding examples, wherein a riser connected to the vertically oriented outlet 15.

33. The process according to any of the proceeding examples, wherein the flow conditioner 10 contains no moving parts.

34. The process according to any of the proceeding examples, wherein the flow conditioner 10 does not require a power supply.

The invention claimed is:

1. A flow conditioner configured for mixing a fluid containing a gas-phase and a liquid-phase, the flow conditioner comprising:

an inlet having a central longitudinal axis and an inner diameter "$D_I$";

a vertically oriented outer shroud section having a central longitudinal axis and an inner diameter "$D_M$", the vertically oriented outer shroud section including a lower half connected to the inlet, an entry region length "$L_E$", and a closed bottommost bottom end, a vertically oriented outlet arranged concentric to, and connected to an uppermost upper end of the vertically oriented outer shroud section, the vertically oriented outlet having an inner diameter "$d_o$";

a vertically oriented perforated pipe arranged concentric to, and housed within an upper part of the vertically oriented outer shroud section the vertically oriented perforated pipe being connected to the vertically oriented outlet, the vertically oriented perforated pipe having a length "l"<$L_E$, an inner diameter "d", and a closed bottommost bottom end;

wherein the entry region length $L_E$ is an entire vertical distance between an intersection of said central longitudinal axes and the uppermost upper end of the vertically oriented outer shroud section and calculated as $$\frac{L_E}{D} = 42.6\left(\frac{V_M}{\sqrt{gD}} + 0.29\right),$$

where $V_M$ is a predetermined mixture velocity, g is gravitational acceleration, and $D=D_M$; and wherein $l<L_E$, $D_M>d$, and $d=d_o$.

2. The flow conditioner of claim 1, wherein a total perforated area of the vertically oriented perforated pipe is in a range of 0.95 to 1.05 of a total circular cross section area of the vertically oriented perforated pipe.

3. The flow conditioner of claim 1, wherein a ratio of a total perforated area of the vertically oriented perforated pipe to a total surface area of the vertically oriented perforated pipe is in a range of 0.1 to 0.3.

4. The flow conditioner of claim 1, further comprising:

the vertically oriented perforated pipe including perforations having a diameter "$d_p$", wherein $d_p$ is sized to create, for the gas phase, a predetermined bubble diameter "$d_b$".

5. The flow conditioner of claim 4, wherein $\frac{1}{4}L_E<l<\frac{1}{2}L_E$.

6. The flow conditioner of claim 1, further comprising:

a feed pipe connected to the inlet and having an inner diameter "$D_F$", $D_M \geq D_F$.

7. The flow conditioner of claim 6, wherein $D_M$ is in a range of 1.25 $D_F$ to 1.75 $D_F$.

8. The flow conditioner of claim 1, the inlet being selected from a group consisting of a horizontally oriented inlet and a downward inclined inlet.

9. The flow conditioner of claim 1, further comprising:

a multi-phase pump connected to the vertically oriented outlet.

10. A process for mixing a fluid containing a gas-phase and a liquid phase, the process comprising:

routing the fluid through a flow conditioner, the flow conditioner comprising:

an inlet having a central longitudinal axis and an inner diameter "$D_I$";

a vertically oriented outer shroud section having a central longitudinal axis and an inner diameter "$D_M$", the vertically oriented outer shroud section including a lower half connected to the inlet, an entry region length "$L_E$", and a closed bottommost bottom end, a vertically oriented outlet arranged concentric to, and connected to an uppermost upper end of the vertically oriented outer shroud section, the vertically oriented outlet having an inner diameter "$d_o$";

a vertically oriented perforated pipe arranged concentric to, and housed within an upper part of the vertically oriented outer shroud section the vertically oriented perforated pipe being connected to the vertically oriented outlet, the vertically oriented perforated pipe having a length "l"<$L_E$, an inner diameter "d", and a closed bottommost bottom end;

wherein the entry region length $L_E$ is an entire vertical distance between an intersection of said central longitudinal axes and the uppermost upper end of the vertically oriented outer shroud section and calculated as $$\frac{L_E}{D} = 42.6\left(\frac{V_M}{\sqrt{gD}} + 0.29\right),$$

where $V_M$ is a predetermined mixture velocity, g is gravitational acceleration, and $D=D_M$; and wherein $l<L_E$, $D_M>d$, and $d=d_o$; and wherein after the routing, the gas-phase is more evenly distributed throughout the fluid than prior to the routing through the flow conditioner.

11. The process of claim 10, wherein a total perforated area of the vertically oriented perforated pipe is in a range of 0.95 to 1.05 of a total circular cross section area of the vertically oriented perforated pipe.

12. The process of claim 10, wherein a ratio of a total perforated area of the vertically oriented perforated pipe to a total surface area of the vertically oriented perforated pipe is in a range of 0.1 to 0.3.

13. The process of claim 10, further comprising:

the vertically oriented perforated pipe including perforations having a diameter "$d_p$", wherein $d_p$ is sized to create, for the gas phase, a predetermined bubble diameter "$d_b$".

14. The process of claim 13, wherein $\frac{1}{4}L_E \leq l \leq \frac{1}{2}L_E$.

15. The process of claim 10, wherein, the flow conditioner further comprises:

a feed pipe connected to the inlet and having an inner diameter "$D_F$", $D_M \geq D_F$.

16. The process of claim 15, wherein $D_M$ is in a range of 1.25 $D_F$ to 1.75 $D_F$.

17. The process of claim 10, wherein, the inlet is selected from a group consisting of a horizontally oriented inlet and a downward inclined inlet.

18. The process of claim 10, wherein, the flow condition further comprises:

a multi-phase pump connected to the vertically oriented outlet.

19. The process of claim 10, further comprising:

further routing the fluid into a riser connected to the vertically oriented outlet.

20. The process of claim 10, wherein, the flow conditioner contains no moving parts.

* * * * *